United States Patent [19]

Iwahara

[11] 4,119,798

[45] Oct. 10, 1978

[54] BINAURAL MULTI-CHANNEL STEREOPHONY

[75] Inventor: Makoto Iwahara, Yokohama, Japan

[73] Assignee: Victor Company of Japan, Limited, Yokohama, Japan

[21] Appl. No.: 720,210

[22] Filed: Sep. 3, 1976

[30] Foreign Application Priority Data

Sep. 4, 1975 [JP] Japan ..... 50-106505

[51] Int. Cl.$^2$ ..... H04R 5/00

[52] U.S. Cl. ..... 179/1 GQ; 179/1 G

[58] Field of Search ..... 179/1 GQ, 1 G, 1 GP, 179/100.1 TD, 100.4 ST, 146 R

[56] References Cited

U.S. PATENT DOCUMENTS

| | | | |
|---|---|---|---|
| 2,481,911 | 9/1949 | DeBoer et al. | 179/1 G |
| 2,563,010 | 8/1951 | DeBoer et al. | 179/1 G |
| 3,824,342 | 7/1974 | Christensen et al. | 179/1 GQ |
| 3,892,917 | 7/1975 | Sotome | 179/1 GQ |
| 3,906,156 | 9/1975 | Cooper | 179/1 GQ |
| 3,911,220 | 10/1975 | Tsurushima | 179/1 GQ |
| 3,940,560 | 2/1976 | Condamines | 179/1 GQ |

FOREIGN PATENT DOCUMENTS

| | | | |
|---|---|---|---|
| 903,298 | 1/1945 | France | 179/1 G |
| 2,344,259 | 4/1975 | Fed. Rep. of Germany | 179/1 GQ |

*Primary Examiner*—Douglas W. Olms

*Attorney, Agent, or Firm*—Lowe, King, Price & Becker

[57] ABSTRACT

A multi-channel stereophonic sound recording system of the invention comprises a three-dimensional structure simulating the human head and a plurality of microphones mounted in the head-simulating structure and angularly spaced about its vertical or principal axis. An acoustic crosstalk cancellation circuit is connected to receive signals from the microphones to provide such signals as will produce a binaural effect when reproduced through loudspeakers without causing dislocation of the virtual sound sources even when the listener turns his face in the sound field.

12 Claims, 16 Drawing Figures

BINAURAL MULTI-CHANNEL STEREOPHONY

The present invention relates generally to stereophony, and in particular to multi-channel stereophony using microphones mounted in dummy heads simulating the human head.

The known binaural sound recording system is a closed circuit type of sound reproducing system in which two microphones, used to pick up the original sound, are each connected to two independent corresponding audio transmission channels which, in turn, are coupled to two independent corresponding earphones worn by the listener. The microphones are mounted in a dummy simulating the human head in shape and dimensions and at locations corresponding to the ears of the human head. The listener is transferred to the location of the dummy head by means of a two-channel sound reproducing system. Because of the direct transfer of signals, the listener has spatial impressions as if sitting at the location of the dummy. However, because of the inconvenience that the listener has in wearing the earphones (headphones), a two-channel loudspeaker reproduction using a dummy head has been proposed to take advantage of the spatial impressions of the binaural system. However, a stereophonic pair of signals is usually reproduced by two loudspeakers standing on the right and left in front of the listener. The listener then receives at his left ear not only the wanted left signal, but an unwated right signal resulting in the effect of acoustical crosstalk which detracts from realism. This acoustical crosstalk can be elimated by an electronic circuit as proposed by P. Damaske (Head-Related Two-Channel Stereophony with Loudspeaker Reproduction, The Journal of the Acoustical Society of America, Vol. 50 No. 4 Part II pages 1109–1115). Reproducing the binaural signals of a dummy head with two loud-speakers is still a problem in that virtual sound sources can only be produced between the two loudspeakers and because a slight movement of the listener's head gives him an impression that the sound sources have been dislocated.

Therefore, the primary object of the invention is to provide multi-channel stereophony with loudspeaker reproduction in which a three-dimensional structure substantially simulating the human head in shape and dimensions includes at least three microphones mounted about the vertical axis of the structure to pickup sound signals which are converted into such signals, which when reproduced by loudspeakers, produce a binaural effect to the listener as if sitting at the location of the microphones.

In accordance with present invention, multichannel stereophony comprises a three-dimensional structure which substantially simulates the human head in shape and dimensions, with microphones mounted about the vertical or principal axis thereof. In a four-channel system, the three-dimensional structure may comprise a pair of dummy heads each simulating the human head in shape and dimensions, with omni-directional microphones mounted in positions corresponding to the ears of the human head. The dummy heads are mounted vertically one upon the other each being oriented at 90° relative to each other. If a sound source is located at a position symmetrical to each dummy head, equal sound signals are produced from the microphones of each dummy head. This approximates a situation in which a listener is sitting at the location of the dummy heads with his face oriented at 45° rightward to a reference direction and a situation in which his face is oriented at 45° leftward to the reference line. A converter is connected to receive the sound signals picked up by the microphones to cancel unwanted sound signals resulting from sound diffraction at the head of the listener so as to provide such signals which when reproduced through loudspeakers produce a binaural effect to the listener sitting in the sound field of the speakers, and a movement of his head does not result in dislocation of reproduced sound sources.

A cylindrical body is employed as the three-dimensional structure to simulate the human head. In the case of a four-channel system, microphones are mounted on the cylindrical surface in diametrically opposed pairs. Earlaps are also provided adjacent to microphones to simulate the earlaps of the human head as sound collectors for the corresponding microphones.

The invention will be further described in connection with the accompanying drawings, in which.

Figure 1:
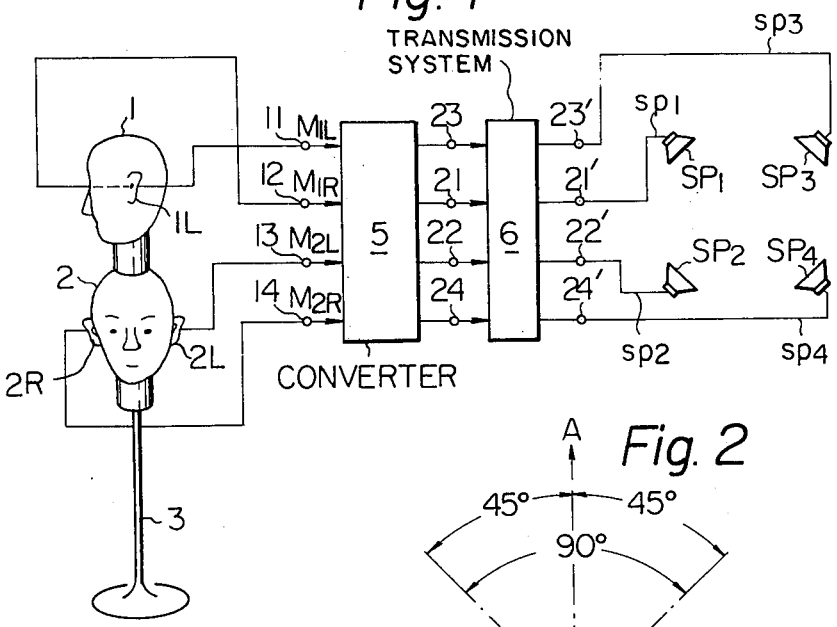
FIG. 1 is a preferred embodiment of the present invention in schematic form.
Figure 3A:
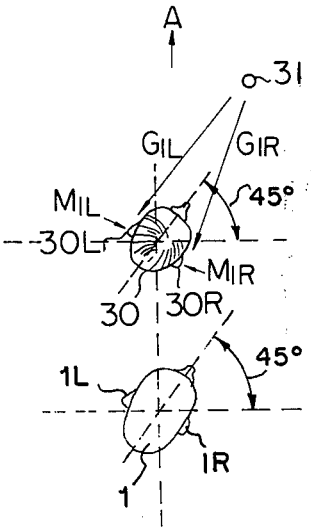
Figure 3B:
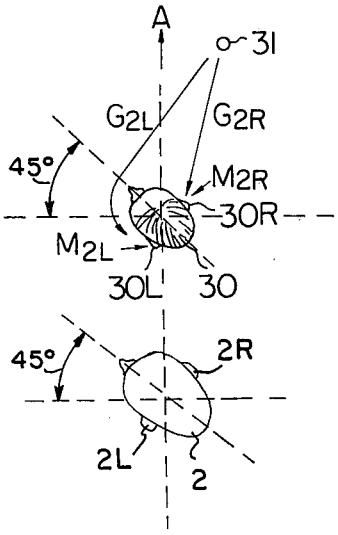
Figure 4:
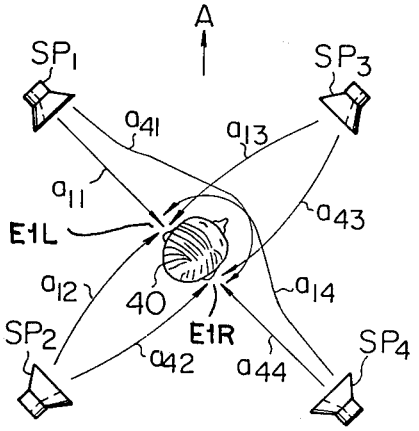
Figure 5:
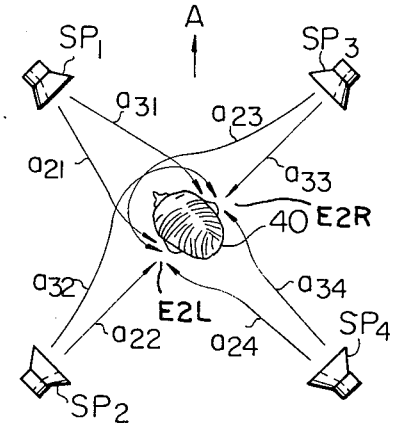
Figure 6:
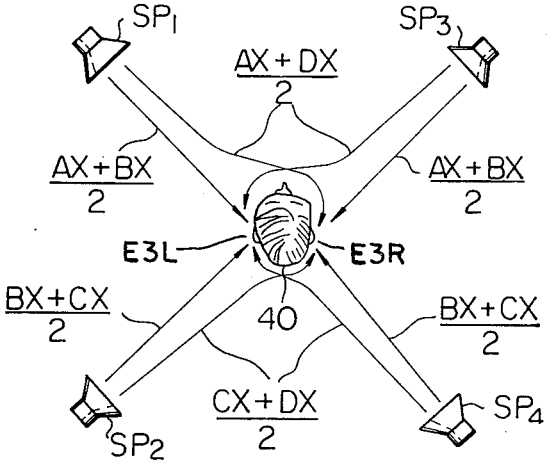
Figure 7:
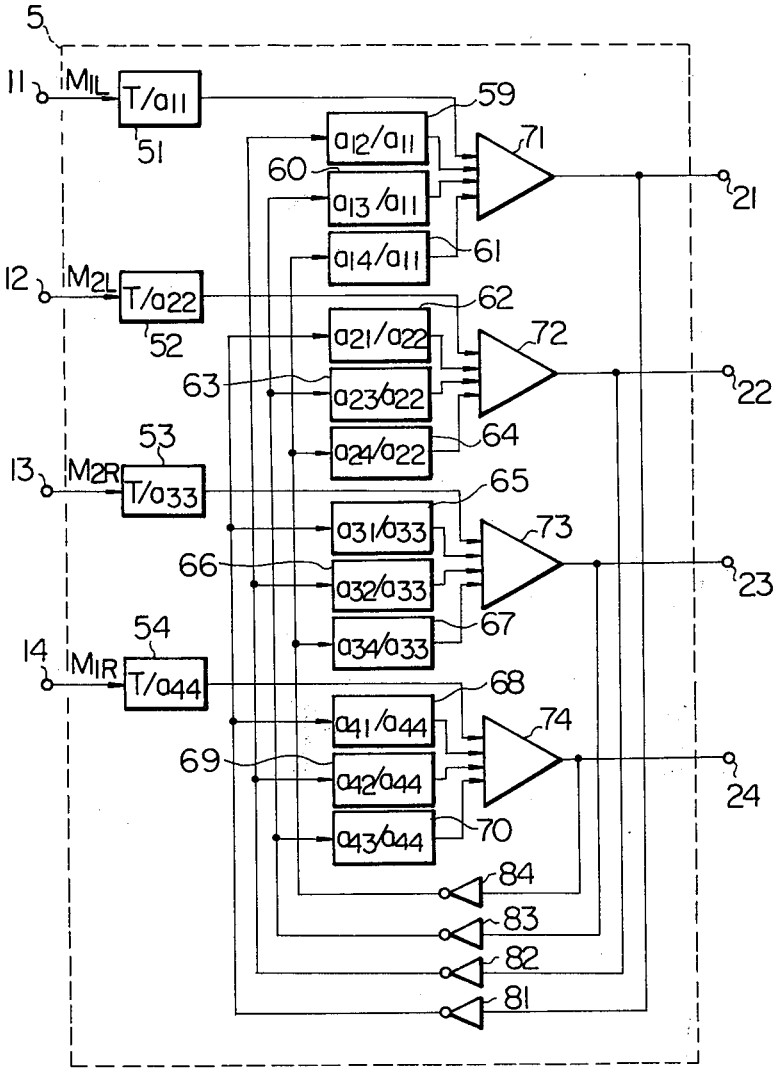
Figure 8:
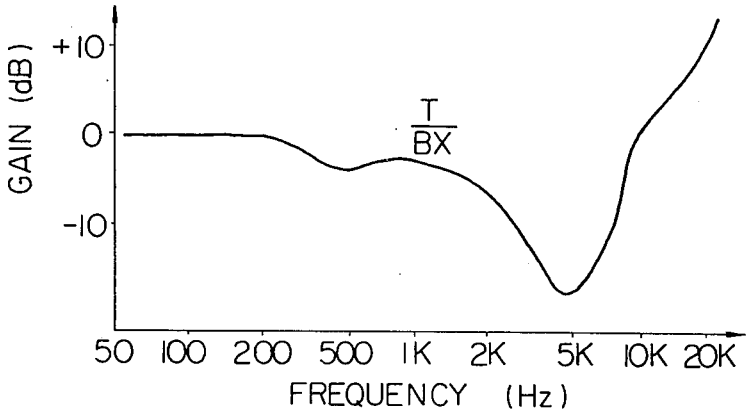
Figure 9:
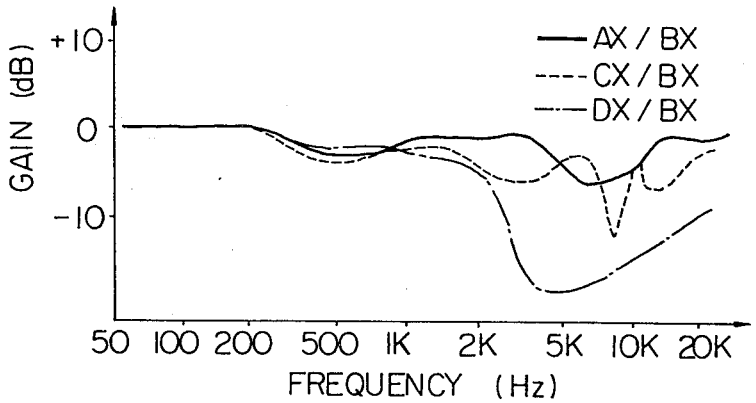
Figure 10A:
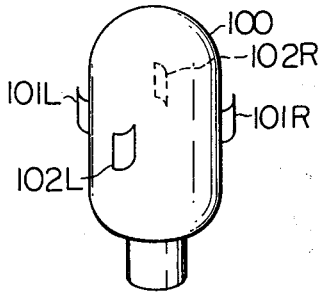
Figure 10B:
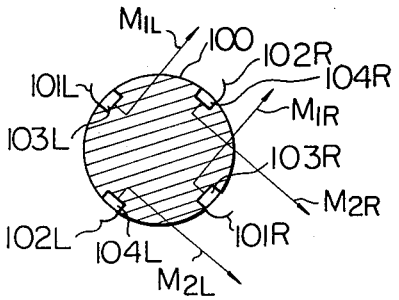
Figure 11:
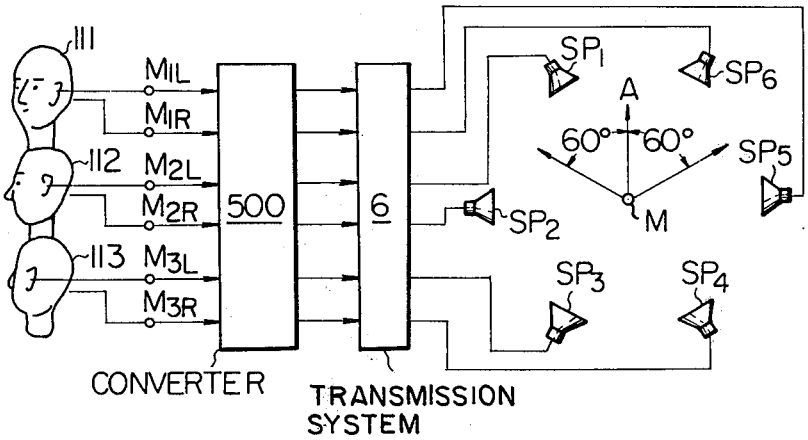
Figure 12:
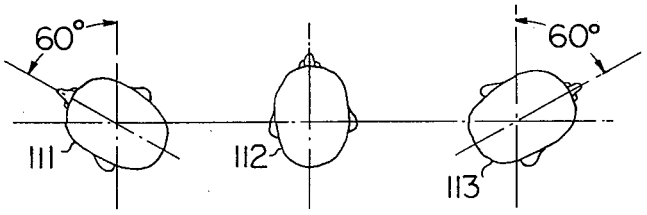
Figure 13:
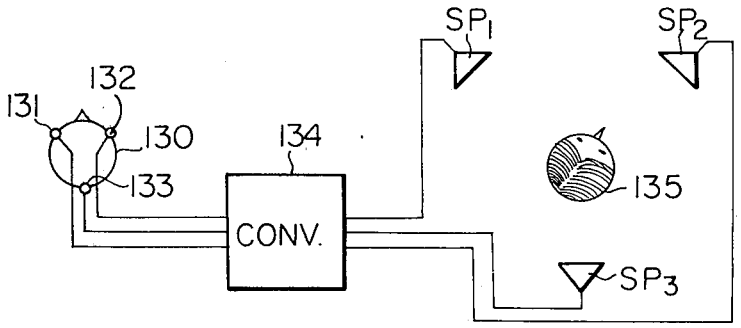

FIGS. 3A and 3B are plan views of a hypothetical listener sitting in a sound field with different orientation of his head with respect to a sound source to illustrate different acoustic transmission characteristics over different acoustic paths between the sound source and the listener's ears, and plan views illustrating artificial heads of FIG. 1 located in the same position as the listener with the same direction of orientation to the same sound source to simulate acoustic transfer characteristics to the ears of the hypothetical listener in the original sound field;

FIGS. 4 and 5 are plan views illustrating various transmission characteristics in sound reproduction;

FIG. 6 is a plan view illustrating transmission characteristics in sound reproduction in which the listener is seated at equal distance from loudspeakers;

FIG. 7 is a detailed circuit diagram of the crosstalk cancellation circuit or converter of the embodiment of FIG. 1;

FIG. 8 is a graphic illustration of the frequency response characteristic of filters used in the circuit of FIG. 7;

FIG. 9 is a graphic illustration of the frequency response characteristics of delay-and-filter circuits used in the circuit of FIG. 7;

FIGS. 10A and 10B are modification of the dummy heads of FIG. 1;

FIG. 11 is a modification of the embodiment of FIG. 1;

FIG. 12 are plan views illustrating the orientation of the dummy heads of FIG. 11;

FIG. 13 is a further modification of the embodiment of FIG. 1; and

Figure 14:
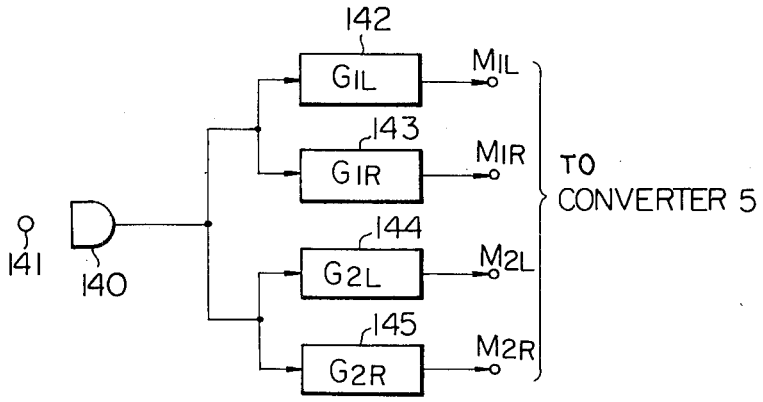

FIG. 14 is a circuit arrangement employing a single microphone located in proximity to a sound source to generate simulated sound signals as provided by dummy heads as shown in FIG. 1.

Figure 2:
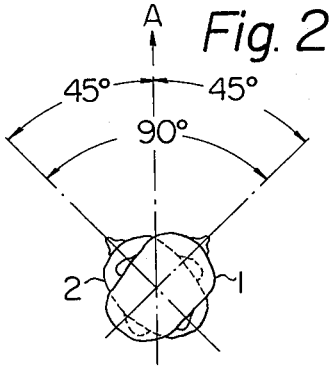
FIG. 2 is a plan view of the dummy heads of FIG. 1.

Referring now to the drawings, particularly to FIG. 1, the stereophonic sound recording and reproducing system embodying the invention is shown and comprises a pair of dummy heads 1 and 2, each simulating the human head in shape and dimensions, and mounted vertically on a stand 3 in a sound field. Each of the dummy heads faces at an angle of 90° relative to the other dummy head and makes an angle of 45° relative to a given reference direction as indicated by the arrow A in FIG. 2. This arrangement is a close approximation of a situation as illustrated in FIG. 3A where the listener 30 is facing rightward at an angle of 45° to the reference direction A in a sound field as provided by a sound source 31 and in FIG. 3B where the listener 30 is facing leftward at an angle of 45° to the reference direction A. The sound waves from source 31 are received at both ears 30L and 30R with different sound intensities and phases because of the different transmission paths they take and the diffraction of sound waves over the face of the listener. For a quantitative discussion of the present invention, the transmission characteristics over the respective sound paths are denoted by $G_{1L}$ and $G_{1R}$ for the left and right ears 30L and 30R and the sound intensities at the respective ears are represented by $M_{1L}$ and $M_{1R}$ in the case of FIG. 3A. Similarly, in FIG. 3B $G_{2L}$ and $G_{2R}$ represent the transmission characteristics and $M_{2L}$ and $M_{2R}$ represent the sound intensities. If the sound source is located at a great distance from the dummy head arrangement of FIG. 1 as compared with the difference in height between dummy heads 1 and 2, the sound intensities at the right and left ears 1R, 1L and 2R, 2L of dummy heads 1 and 2, respectively, are substantially equal to the sound intensities $M_{1R}$, $M_{1L}$, $M_{2R}$, and $M_{2L}$, respectively, received at the ears of the listener 30. Each of the dummy heads has a pair of microphones (not shown) mounted at locations corresponding to the ears of the human head. The sound signals from these microphones are designated by the same characters $M_{1L}$, $M_{1R}$, $M_{2L}$ and $M_{2R}$ as used to represent the sound intensities of FIGS. 3A and 3B and fed into a converter or crossstalk cancellation circuit 5 through respective input terminals 11, 12, 13 and 14. The converted signals are then coupled through output terminals 21, 22, 23 and 24 to a four-channel transmission system 6 which may be an amplifier, a radio transmitter and receiver, or a phonograph recorder and reproducer, and thence to loudspeakers $SP_1$, $SP_2$, $SP_3$ and $SP_4$ through terminals 21', 22', 23' and 24', respectively.

In FIG. 4, a listener 40 is located equal distances from the speakers $SP_1$, $SP_2$, $SP_3$ and $SP_4$ and faces leftward at an angle of 45° relative to the reference direction A so as to face the speaker $SP_3$. The sound signals $E_{1L}$ and $E_{1R}$ at the left and right ears respectively of the listener 40 from the loudspeakers $SP_1$ to $SP_4$ are expressed by the following equation:

$$\begin{bmatrix} E_{1L} \\ E_{1R} \end{bmatrix} = \begin{bmatrix} a_{11} & a_{12} & a_{13} & a_{14} \\ a_{41} & a_{42} & a_{43} & a_{44} \end{bmatrix} \begin{bmatrix} sp1 \\ sp2 \\ sp3 \\ sp4 \end{bmatrix} \quad (1)$$

where, $a_{11}$, $a_{12}$, $a_{13}$ and $a_{14}$ are sound transmission characteristics over acoustic paths between speakers $SP_1$, $SP_2$, $SP_3$ and $SP_4$, respectively, and the left ear of listener 40, and $a_{41}$, $a_{42}$, $a_{43}$ and $a_{44}$ are sound transmission characteristics over acoustic paths between speakers $SP_1$, $SP_2$, $SP_3$ and $SP_4$, respectively, and the right ear of listener 40, and *sp1*, *sp2*, *sp3* and *sp4* represent the signals which are to be fed into the respective loudspeakers $SP_1$ to $SP_4$.

Similarly, in FIG. 5, the listener 40 is located equal distances from the speakers $SP_1$ to $SP_4$ and faces rightward at an angle of 45° relative to the reference direction A so as to face the speaker $SP_1$. The sound signals $E_{2L}$ and $E_{2R}$ at the left and right ears respectively of the listener 40 from the loudspeakers $SP_1$ to $SP_4$ are given by the following equation:

$$\begin{bmatrix} E_{2L} \\ E_{2R} \end{bmatrix} = \begin{bmatrix} a_{21} & a_{22} & a_{23} & a_{24} \\ a_{31} & a_{32} & a_{33} & a_{34} \end{bmatrix} \begin{bmatrix} sp1 \\ sp2 \\ sp3 \\ sp4 \end{bmatrix} \quad (2)$$

where, $a_{21}$, $a_{22}$, $a_{23}$ and $a_{24}$ are sound transmission characteristics over acoustic paths between speakers $SP_1$, $SP_2$, $SP_3$ and $SP_4$, respectively, and the left ear of the listener 40, and $a_{31}$, $a_{32}$, $a_{33}$ and $a_{34}$ represent sound transmission characteristics over acoustic paths between speakers $SP_1$, $SP_2$, $SP_3$ and $SP_4$, respectively, and the right ear of the listener 40.

From equations 1 and 2 the following is obtained:

$$\begin{bmatrix} E_{1L} \\ E_{2L} \\ E_{2R} \\ E_{1R} \end{bmatrix} = A \cdot \begin{bmatrix} sp1 \\ sp2 \\ sp3 \\ sp4 \end{bmatrix} \quad (3)$$

where, $$A = \begin{bmatrix} a_{11} & a_{12} & a_{13} & a_{14} \\ a_{21} & a_{22} & a_{23} & a_{24} \\ a_{31} & a_{32} & a_{33} & a_{34} \\ a_{41} & a_{42} & a_{43} & a_{44} \end{bmatrix}$$

To determine the entries of the matrix, an acoustic transfer characteristic is established between each of the speakers and each ear of the listener at differing angular positions of the listener's ears. The transfer characteristic is such that for each angular position of the listener's ear relative to an axis along which he is facing (axis A, FIGS. 4–6) there is a corresponding angular position between a second, sound source axis (axis A, FIG. 2) and an artificial ear. Thereby, the acoustic transfer characteristic *ajk* for the entry at the *j*th row and *k*th column of the matrix, represents the acoustic transfer characteristic from a speaker *k* to a listener's ear that is angularly displaced from the first axis by an angle that corresponds with the angular displacement of an artificial ear *j* from the axis, where *j* and *k* each are selectively all integers ranging from unity to N.

The listener 40 in FIG. 4 would have the same impression as if he were sitting in the same location as the artificial head 1 with respect to the sound source 31 shown in FIG. 3A with his head oriented in a direction corresponding to the direction of orientation of the artificial head 1 with respect to sound source 31. Similarly, listener 40 in FIG. 5 would have the same impression as if he were sitting in the location of the artificial head 2 of FIG. 3B with his head oriented in a direction corresponding to the sound source 31. Therefore, signals $E_{1L}$, $E_{2L}$, $E_{2R}$ and $E_{1R}$ are equal to signals $M_{1L}$, $M_{2L}$, $M_{2R}$ and $M_{1R}$, respectively, and the following equation holds:

$$\begin{bmatrix} sp1 \\ sp2 \\ sp3 \\ sp4 \end{bmatrix} = A^{-1} \begin{bmatrix} M_{1L} \\ M_{2L} \\ M_{2R} \\ M_{1R} \end{bmatrix} \quad (4)$$

where, $A^{-1}$ is the inverse matrix of A.

Since the matrix A possesses a certain degree of time delaying factor, the inverse of the matrix A would place the output signal in advance of the input signal. This is unrealistic and therefore a certain degree of time delay T must be introduced when the inverse matrix $A^{-1}$ is realized. Therefore, Equation (4) is rewritten as follows:

$$\begin{bmatrix} sp1 \\ sp2 \\ sp3 \\ sp4 \end{bmatrix} = T \cdot A^{-1} \begin{bmatrix} M_{1L} \\ M_{2L} \\ M_{2R} \\ M_{1R} \end{bmatrix} \quad (5)$$

The converter circuit 5 is designed to satisfy Equation (5).

By substituting Equation (5) into Equation (3), the sound intensities represented by $E_{1L}$, $E_{1R}$, $E_{2L}$ and $E_{2R}$ can be given as follows:

$$\begin{bmatrix} E_{1L} \\ E_{2L} \\ E_{2R} \\ E_{1R} \end{bmatrix} = A \cdot T \cdot A^{-1} \begin{bmatrix} M_{1L} \\ M_{2L} \\ M_{2R} \\ M_{1R} \end{bmatrix} = T \cdot \begin{bmatrix} M_{1L} \\ M_{2L} \\ M_{2R} \\ M_{1R} \end{bmatrix} \quad (6)$$

In accordance with the afore-mentioned arrangement, when the listener 40, as in FIG. 4, orients his head at 45° rightwardly to the reference line A, he will receive approximately the same signals as $M_{1L}$ and $M_{1R}$ with a time delay T which the listener 30 in FIG. 3A would receive with his head oriented in the same direction. Similarly, with his head oriented at 45° leftwardly to the reference line A as in FIG. 5, he will receive approximately the same signals as $M_{2L}$ and $M_{2R}$ with a time delay T which he would receive as if he were sitting in front of the sound source 31 in FIG. 3B with his head oriented in the same direction.

Since the listener 40 is located at equal distances from the speakers, the following relations exist by examination of FIGS. 4 and 5:

$$AX = a_{13} = a_{43} = a_{21} = a_{31}$$

$$BX = a_{11} = a_{22} = a_{33} = a_{44}$$

$$CX = a_{12} = a_{42} = a_{24} = a_{34}$$

$$DX = a_{14} = a_{41} = a_{32} = a_{23}$$

It will be understood from the above that with the assumption that the listener 40 directly face one of the speakers $SP_1$ to $SP_4$, AX is a transmission characteristic over the path between the front speaker ($SP_3$ in case of FIG. 4) and the listener's ears, BX being a characteristic over the path between the side speaker ($SP_1$ or $SP_4$ in case of FIG. 4) and the nearest ear, CX being a characteistic over the path between the rear speaker ($SP_2$ in case of FIG. 4) and both ears, and DX being a characteristic over the path between the side speaker and the farthest ear.

When the listener 40 turns his head to orient his face to the direction A (FIG. 6), the transmission characteristics between speaker $SP_1$ and the left ear and between speaker $SP_3$ and the right ear will approximately be (AX + BX)/2 and those between speaker $SP_1$ and the right ear and between speaker $SP_3$ and the left ear will approximately be (AX + DX)/2. Likewise, the transmission characteristics between speaker $SP_2$ and the left ear and speaker $SP_4$ and the right ear will approximately be (BX + CX)/2 and those between speaker $SP_2$ and the right ear and speaker $SP_4$ and the left ear will approximately be (CX + DX)/2.

The sound intensities $E_{3L}$ and $E_{3R}$ at the left and right ears, respectively, of the listener 40 will then be given by the following equation:

$$\begin{bmatrix} E_{3L} \\ E_{3R} \end{bmatrix} = \begin{bmatrix} \frac{AX+BX}{2} & \frac{BX+CX}{2} & \frac{DX+AX}{2} & \frac{CX+DX}{2} \\ \frac{DX+AX}{2} & \frac{CX+DX}{2} & \frac{AX+BX}{2} & \frac{BX+CX}{2} \end{bmatrix} \begin{bmatrix} sp1 \\ sp2 \\ sp3 \\ sp4 \end{bmatrix} \quad (7)$$

Since $E_{1L}$, $E_{2L}$, $E_{2R}$ and $E_{1R}$ given by $$\begin{bmatrix} E_{1L} \\ E_{2L} \\ E_{2R} \\ E_{1R} \end{bmatrix} = \begin{bmatrix} BX & CX & AX & DX \\ AX & BX & DX & CX \\ AX & DX & BX & CX \\ DX & CX & AX & BX \end{bmatrix} \begin{bmatrix} sp1 \\ sp2 \\ sp3 \\ sp4 \end{bmatrix} \quad (8)$$

Therefore, $E_{3L}$ and $E_{3R}$ are given by $$E_{3L} = \frac{E_{1L} + E_{2L}}{2} \quad (9)$$

$$E_{3R} = \frac{E_{1R} + E_{2R}}{2} \quad (10)$$

It will be appreciated that with his head oriented in the direction A in FIG. 6, the listner 40 will receive signals which are approximately equal to a mean value of the signals received when his head is oriented in such directions as shown in FIGS. 4 and 5, so that the listener 40 receives approximately the same signal as if sitting in front of the original sound source 31 with his head oriented in the direction A. The same explanation can be applied to situations in which the listener 40 orients his head in any direction between the speakers $SP_2$ and $SP_3$, so that the listener receives substantially the same signals which he would receive in the original sound field with his head oriented in the corresponding directions.

In order to realize crosstalk cancellation circuit 5, Equation (5) is rewritten as follows:

$$\left.\begin{aligned} TM_{1L} &= a_{11}\,sp1 + a_{12}\,sp2 + a_{13}\,sp3 + a_{14}\,sp4 \\ TM_{2L} &= a_{21}\,sp1 + a_{22}\,sp2 + a_{23}\,sp3 + a_{24}\,sp4 \\ TM_{2R} &= a_{31}\,sp1 + a_{32}\,sp2 + a_{33}\,sp3 + a_{34}\,sp4 \\ TM_{1R} &= a_{41}\,sp1 + a_{42}\,sp2 + a_{43}\,sp3 + a_{44}\,sp4 \end{aligned}\right] \quad (11)$$

$$\left.\begin{aligned} sp1 &= \frac{T}{a_{11}} M_{1L} - \frac{a_{12}}{a_{11}} sp2 - \frac{a_{13}}{a_{11}} sp3 - \frac{a_{14}}{a_{11}} sp4 \\ sp2 &= \frac{T}{a_{22}} M_{2L} - \frac{a_{21}}{a_{22}} sp1 - \frac{a_{23}}{a_{22}} sp3 - \frac{a_{24}}{a_{22}} sp4 \\ sp3 &= \frac{T}{a_{33}} M_{2R} - \frac{a_{31}}{a_{33}} sp1 - \frac{a_{32}}{a_{33}} sp2 - \frac{a_{34}}{a_{33}} sp4 \\ sp4 &= \frac{T}{a_{44}} M_{1R} - \frac{a_{41}}{a_{44}} sp1 - \frac{a_{42}}{a_{44}} sp2 - \frac{a_{43}}{a_{44}} sp4 \end{aligned}\right] \quad (12)$$

The crosstalk cancellation circuit 5 provides such signals sp1 to sp4 which when fed into the loudspeakers $SP_1$ to $SP_4$ will produce a binaural effect to the listener 40 located in the sound field of the loudspeakers. Signals $SP_1$ to $SP_4$ cancel any acoustical crosstalk signals such as signals over the paths having transmission characteristics $a_{14}$ and $a_{41}$ of FIG. 4 and those over the paths having transmission characteristics $a_{23}$ and $a_{32}$ of FIG. 5, so that in FIG. 6 the crossover signals due to (AX + DX)/2 and (CX + DX)/2 are cancelled. Crosstalk cancellation is achieved when Equation 12 is satisfied.

As illustrated in FIG. 7, the crosstalk cancellation circuit 5 comprises filters 51 to 54 and various delay-and-filter circuits 59 to 70. Filters 51, 52, 53, and 54 have their input terminals connected to the input terminals 11 to 41 of the crosstalk cancellation circuit 5 and their output terminals each connected to one input terminal of adders 71, 72, 73 and 74 respectively. The filters 51 to 54 are designed to possess particular frequency response characteristics $T/a_{11}$, $T/a_{22}$, $T/a_{33}$ and $Ta_{44}$, respectively. Since $a_{11} = a_{22} = a_{33} = a_{44}$ as described above, it can be approximated that each filter is designed to possess a response characteristic T/BX as illustrated in FIG. 8.

The output terminal of the adder 72 is connected through an inverter 82 and delay-and-filter circuit 59 to a second input terminal of the adder 71 and the output terminal of adder 73 is connected through an inverter 83 and circuit 60 to a third input terminal of the adder 71 and the output terminal of adder 74 is connected through an inverter 84 and circuit 61 to a fourth input terminal of the adder 71. In a similar manner, the output of the adder 71 is connected through an inverter 81 and circuit 62 to a second input terminal of adder 72 which has its third and fourth input terminals connected to the output of circuits 63 and 64 which have their inputs connected respectively to the output of inverter 83 and 84, respectively. Similarly, adder 73 has its second, third and fourth input terminals connected to the output of circuits 65, 66 and 67 respectively whose input terminals are connected to the output of inverters 81, 82 and 84, respectively, and adder 74 has its second, third and fourth input terminals connected to the output of circuits 68, 69 and 70 respectively whose input terminals are connected to the output of inverters 81, 82 and 83, respectively.

Delay-and-filter circuits 59 to 61 are designed to possess frequency response and time delay characteristics $a_{12}/a_{11}$, $a_{13}/a_{11}$ and $a_{14}/a_{11}$, respectively, or by approximation CX/BX, AX/BX and DX/BX, respectively whose response characteristics curves are illustrated in FIG. 9. Circuits 62 to 64 are designed to possess frequency response and delay characteristics $a_{21}/a_{22}$, $a_{23}/a_{22}$ and $a_{24}/a_{24}$, respectively, or by approximation AX/BX, DX/BX and CX/BX, respectively. Likewise, circuits 65 to 67 have frequency response and delay characteristics $a_{31}/a_{33}$ or AX/BX, $a_{32}/a_{33}$ or DX/BX, and $a_{34}/a_{33}$ or CX/BX, respectively and circuits 68 to 70 have frequency response and delay characteristics $a_{41}/a_{44}$ or DX/BX, $a_{42}/a_{44}$ or CX/BX and $a_{43}/a_{44}$ or AX/BX, respectively. The delay times for AX/BX, CX/BX and DX/BX are approximately 350, 350 and 700 microseconds, respectively, over the spectrum of the entire frequency range.

Signals sp1 to sp4 therefore appear at the output terminals 21 to 24 respectively of the crosstalk cancellation circuit 5 and are fed through transmission system 6 into speakers $SP_1$ to $SP_4$, respectively. The signals sp1 to sp4 are then emitted from the speakers $SP_1$ to $SP_4$ over respective acoustic paths to the right and left ears of the listener 40 who then receives them as sound intensities $E_{1L}$ and $E_{1R}$, or $E_{2L}$ and $E_{2R}$ in accordance with Equation (3) when the listener faces rightward or leftward at an angle of 45° to the reference direction.

When the listener is seated at the center of speakers $SP_1$ to $SP_4$ he will be given an impression as if he were hearing the original sound at the location of the dummy heads 1 and 2 and turning of his head will not result in dislocation of virtual sound sources as encountered with the prior art binaural loudspeaker reproduction.

In a modification of the embodiment of FIG. 1 as shown in FIGS. 10A and 10B, the dummy heads 1 and 2 are replaced by a cylindrical head 100 which is provided with a first pair of earlaps 101L and 101R and a second pair of earlaps 102L and 102R. Earlaps 101L and 101R are disposed diametrically opposite to each other. Similarly, earlaps 102L and 102R are disposed diametrically opposite to each other and displaced 45° from the earlaps 101L and 101R. Microphones 103L and 103R are mounted inside the cylindrical head in positions corresponding to the left and right earlaps 101L and 101R to generate signals $M_{1L}$ and $M_{1R}$, respectively, and microphones 104L and 104R are mounted in positions corresponding to the left and right earlaps 102L and 102R to generate signals $M_{2L}$ and $M_{2R}$, respectively.

If more than 4 channels, for example 6, are desired, three dummy heads 111, 112 and 113 are stacked and oriented as shown in FIG. 11 so that they face in different directions, with the upper dummy 111 facing leftward at an angle of center 60° to the center dummy 112 and the lower dummy 113 facing rightward at an angle of 60° to the center dummy 112; the orientations are illustrated in FIG. 12. Signals $M_{1L}$, $M_{1R}$, $M_{2L}$, $M_{2R}$ and $M_{3L}$, $M_{3R}$ are respectively derived from the left and right microphones (not shown) mounted in the dummy heads 111, 112 and 113 and supplied to the converter 500 which is constructed in a similar manner to that shown in FIG. 7. Loudspeakers $SP_1$ to $SP_6$ are located at the vertices of a hexagon as illustrated. The listener is positioned at a point M equi-distant from the speakers $SP_1$ to $SP_6$. In the embodiment of FIG. 11, the listener receives the sound signal which gives him an impression as if he were sitting at the location of the dummy head 112 when he faces the direction A. A line along direction A bisects the angle formed by the lines connecting $SP_1$, M and $SP_6$. When the listener faces right or leftward as much as 60° to the direction A he would receive a signal which gives him an impression as if he were sitting at the location of the dummy head 113 or 111, respectively.

Various modifications of the previous embodiments are possible without departing from the scope of the invention. For example, a three channel stereophony can be realized by locating a set of three microphones 131, 132 and 133 on dummy head or cylindrical body 130 similar to that shown in FIG. 10A such that the microphones 131 and 132 are positioned on the front side of the dummy head 130 and the microphone 133 on its rear side as illustrated in FIG. 13. In this arrangement, the front microphones 131 and 132 permit simulation of the situation illustrated in FIG. 3A while the rear microphone 133 permits approximation of the situation illustrated in FIG. 3B by using only one ear to pick up the acoustic energy. A three-channel converter 134 constructed in a similar manner to that shown in FIG. 7 is provided to receive the signals from the microphones 131 to 133. The output signals from the converter/transducer 134 are applied to a set of three speakers $SP_1$, $SP_2$ and $SP_3$, with the speakers $SP_1$ and $SP_2$ located in front of the listener 135 and the speaker $SP_3$ located at the rear of the listener.

In the foregoing description, the original sound sources are recorded with the use of a plurality of stacked dummy heads each simulating the human head in shape and dimensions with microphones in positions corresponding to the eardrums or a cylindrical body provided with microphones which are disposed diametrically opposite pairs; each microphone has an earlap as a sound collector simulating the human earlap. It is also possible to electronically simulate the human head by locating a microphone 140 in proximity to the sound source 141 to feed the collected sound signal to a plurality of circuits 142, 143, 144 and 145 having their input terminals connected together to the output of the microphone as shown in FIG. 14. Each of the circuits 142 to 145 may comprise a phase shifter, filter and attenuator to impart one of frequency response characteristics $G_{1L}$, $G_{1R}$, $G_{2L}$ and $G_{2R}$ to generate an output ($M_{1L}$, $M_{1R}$, $M_{2L}$, $M_{2R}$) which is similar to that applied to the converter 5 of FIG. 1.

The foregoing description shows only preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. Apparatus for deriving signals to be applied to a multi-channel stereophony using N loudspeakers located around a listener at equal distances therefrom, wherein N is at least three, the listener normally being positioned so he is facing in a predetermined angular relationship with respect to said speakers, said predetermined angular position being along a first axis, comprising a three-dimensional structure located with respect to an axis of a sound source for simulating a human head in shape and dimensions, said sound source axis having a second axis, corresponding with the first axis, said structure having N artificial ears angularly spaced apart from each other about the vertical axis of said structure so that each of said artificial ears assumes a particular angular position relative to said second axis when said structure is oriented about its vertical axis in a given direction;

N microphones mounted respectively in the corresponding positions of said artificial ears for deriving first electrical signals M1, M2 . . . MN;

N audio transmission channels;

an acoustic transfer characteristic being established between each of said speakers and each ear of the listener at differing angular positions of the listener's ears, the transfer characteristic being such that for each angular position of the listener's ear relative to the first axis there is a corresponding angular position between the second axis and an artificial ear, whereby the acoustic transfer characteristic ajk represents the acoustic transfer characteristic from a speaker *k* to a listener's ear that is angularly displaced from the first axis by an angle that corresponds with the angular displacement of an artificial ear *j* from the second axis, where *j* and *k* each are selectively all integers ranging from unity to N; and crosstalk cancellation circuit means for converting said first electrical signals M1, M2 . . . MN into second electrical signals *sp*1, *sp*2 . . . *sp*N respectively in accordance with the following equation for application respectively to said loudspeakers through said transmission channels without producing the effect of acoustic crosstalk which might be perceptible by said listener if said first signals were supplied directly to said loudspeakers:

$$\begin{bmatrix} sp1 \\ sp2 \\ \vdots \\ spN \end{bmatrix} = T \cdot A^{-1} \begin{bmatrix} M1 \\ M2 \\ \vdots \\ MN \end{bmatrix}$$

where T is a delay time and $A^{-1}$ is the inverse matrix of a matrix A having at the *j*-th row and the *k*-th column the acoustic transfer characteristic *ajk*.

2. The apparatus of claim 1 wherein each of said microphones is an omni-directional microphone.

3. The apparatus of claim 1, wherein N is three and said structure comprises a cylindrical body wherein said microphones are mounted circumferentially thereon and two of said microphones are mounted forwardly of the body with an angular displacement of 90° therebetween and the other of said microphones is mounted rearwardly of the body with equal angular displacement from said two microphones.

4. The apparatus of claim 1, wherein said structure comprises a cylindrical body and wherein said microphones are mounted in diametrically opposite positions on the circumference of said body.

5. The apparatus of claim 1, wherein N is four and said microphones are mounted with an angular displacement of 90° therebetween.

6. The apparatus of claim 1, wherein said crosstalk cancellation circuit means comprises N input terminals connected to the output of said microphones, N output terminals adapted for connection to said loudspeakers through said channels, N filter circuits each having a particular frequency response characteristic, N adders each having N input terminals and an output terminal which is connected to one of said N output terminals, N groups of delay-and-filter circuits each group including (N-1) delay-and-filter circuits each having a particular frequency response and delay characteristic, and N inverters, wherein a respective one of the first-mentioned N input terminals is connected through one of the filter circuits to one input terminal of one of said adders, and the output terminal of a respective one of the adders is further connected through one of the inverters and one of the delay-and-filter circuits of a delay-filter circuit group to another input terminal of another adder.

7. Apparatus for deriving signals to be applied to a multi-channel stereophony using N loudspeakers located around a listener at equal distances therefrom, wherein N is at least three, the listener normally being positioned so he is facing in a predetermined angular relationship with respect to said speakers, said predetermined angular position being along a first axis, comprising a three-dimensional structure having a plurality of vertically spaced artificial human heads having N artificial ears, each of said artificial human heads being mounted on a common vertical axis and oriented horizontally in a particular direction with respect to an axis of a sound source so that each of said artificial ears assumes a particular angular position relative to said sound source axis, said sound source axis having a second axis corresponding with the first axis;

N microphones respectively mounted in the corresponding positions of said artificial ears for deriving first electrical signals M1, M2 . . . MN;

N audio transmission channels;

an acoustic transfer characteristic being established between each of said speakers and each ear of the listener at differing angular positions of the listener's ears, the transfer characteristic being such that for each angular position of the listener's ear relative to the first axis there is a corresponding angular position between the second axis and an artificial ear, whereby the acoustic transfer characteristic *ajk* represents the acoustic transfer characteristic from a speaker *k* to a listener's ear that is angular displaced from the first axis by an angle that corresponds with the angular displacement of an artificial ear *j* from the second axis, where *j* and *k* each are selectively all integers ranging from unity to N; and crosstalk cancellation circuit means for converting said first electrical signals M1, M2 . . . MN into second electrical signals *sp*1, *sp*2 . . . spN respectively in accordance with the following equation for application respectively to said loudspeakers through said transmission channels without producing the effect of acoustic crosstalk which might be perceptible by said listener if said first signals were supplied directly to said loudspeakers:

$$\begin{bmatrix} sp1 \\ sp2 \\ \vdots \\ spN \end{bmatrix} = T \cdot A^{-1} \begin{bmatrix} M1 \\ M2 \\ \vdots \\ MN \end{bmatrix}$$

where T is a delay time and $A^{-1}$ is the inverse matrix of a matrix A having at the *j*-th row and the *k*-th column the acoustic transfer characteristic *ajk*.

8. The apparatus of claim 7, wherein only two of said artificial heads are included and each of the artificial heads is oriented at right angles to the orientation of the other.

9. The apparatus of claim 7, wherein only three of said artificial heads are included and each of said artificial heads is oriented at 60° to the orientation of another.

10. The apparatus of claim 7, wherein said crosstalk cancellation circuit means comprises N input terminals connected to the output of said microphones, N output terminals adapted for connection to said loudspeakers through said channels, N filter circuits each having a particular frequency response characteristic, N adders each having N input terminals and an output terminal which is connected to one of said N output terminals, N groups of delay-and-filter circuits each group including (N-1) delay-and-filter circuits each having a particular frequency response and delay characteristic, and N inverters, wherein a respective one of the first-mentioned N input terminals is connected through one of the filter circuits to one input terminal of one of said adders, and the output terminal of the respective one of the adders is further connected through one of the inverters and one of the delay-and-filter circuits of a delay and filter circuit group to another input terminal of another adder.

11. Apparatus for deriving signals to be applied to a multi-channel stereophony using N loudspeakers located around a listener at equal distances therefrom, wherein N is at least three, the listener normally being positioned so he is facing in a predetermined angular relationship with respect to said speakers, said predetermined angular position being along a first axis, comprising:

electronic simulating means for simulating the acoustic perception of human ears in different orientations to an axis of a sound source so that the simulated ears assume N angular positions relative to said sound source and including a microphone located in proximity to said sound source and a plurality of electronic circuits connected to said microphone for generating first signals M1, M2 . . . MN each respectively representing the signal received at a simulated ear when said simulated ear assumes a respective one of said N angular positions, said sound source axis having a second axis corresponding with the first axis;

N audio transmission channels;

an acoustic transfer characteristic being established between each of said speakers and each ear of the listener at differing angular positions of the listener's ears, the transfer characteristic being such that for each angular position of the listener's ear relative to the first axis there is a corresponding angular position between the second axis and a simulated ear, whereby the acoustic transfer characteristic *ajk* represents the acoustic transfer characteristic from a speaker *k* to a listener's ear that is angularly displaced from the first axis by an angle that corresponds with the angular displacement of a simulated ear *j* from the second axis, where *j* and *k* each are selectively all integers ranging from unity to N; and crosstalk cancellation circuit means for converting said first electrical signals M1, M2 . . . MN into second electrical signals *sp*1, *sp*2 . . . *sp*N respectively in accordance with the following equation for application respectively to said loudspeakers through said transmission channels without producing the effect of acoustic crosstalk which might be perceptible by said listener if said first signals were supplied directly to said loudspeakers:

$$\begin{bmatrix} sp1 \\ sp2 \\ \vdots \\ spN \end{bmatrix} = T \cdot A^{-1} \begin{bmatrix} M1 \\ M2 \\ \vdots \\ MN \end{bmatrix}$$

where T is a delay time and $A^{-1}$ is the inverse matrix of a matrix A having at the *j*-th row and the *k*-th column the acoustic transfer characteristic *ajk*.

12. The apparatus of claim 11, wherein said crosstalk cancellation circuit means comprises N input terminals connected to the output of said microphones, N output terminals adapted for connection to said loudspeakers through said channels, N filter circuits each having a particular frequency response characteristics, N adders each having N input terminals and an output terminal which is connected to one of said N output terminals, N groups of delay-and-filter circuits, each group including (N-1) delay-and-filter circuits each having a particular frequency response and delay characteristic, and N inverters, wherein a respective one of the first-mentioned N input terminals is connected through one of the filter circuits to one input terminal of one of said adders, and the output terminal of a respective one of the adders is further connected through one of the inverters and one of the delay-and-filter circuits of a delay-and-filter circuit group to another input terminal of another adder.

* * * * *